United States Patent [19]

Quakenbush

[11] 4,159,145

[45] Jun. 26, 1979

[54] RETRACTIBLE ARMREST SUPPORT

[75] Inventor: Howard M. Quakenbush, Apple River, Ill.

[73] Assignee: Flexsteel Industries, Inc., Dubuque, Iowa

[21] Appl. No.: 828,733

[22] Filed: Aug. 29, 1977

[51] Int. Cl.[2] ..... A47C 13/00

[52] U.S. Cl. ..... 297/113; 297/417

[58] Field of Search ..... 297/113, 417

[56] References Cited

U.S. PATENT DOCUMENTS

| | | | |
|---|---|---|---|
| 2,646,107 | 7/1953 | Murphy | 297/113 |
| 3,168,346 | 2/1965 | Rei | 297/113 |

*Primary Examiner*—James C. Mitchell

*Attorney, Agent, or Firm*—Brezina & Lund

[57] ABSTRACT

An armrest of a seating structure has one end connected to a back through means such that the armrest pivots between a horizontal forwardly projecting arm support position and a storage position in which it is disclosed in a recess in a corner formed by front and side surfaces of the back. The pivot axis is so oriented that the armrest moves into a recess which is inwardly sloped because of a corresponding slope of the side of the back. The connection means provides for relative axial movement to allow the armrest to slide sidewardly outwardly during movement from the storage position to the arm support position. A radially extending pin in one member extends into an angularly and axially extending slot in another to obtain such axial movement in response to pivotal movement of the armrest.

3 Claims, 7 Drawing Figures

RETRACTIBLE ARMREST SUPPORT

This invention relates to a retractible armrest support and more particularly to a support in which an armrest when in use provides maximum support and comfort for the user while when not in use being compactly and unobtrusively stored. The support is relatively simple and inexpensive in operation while being rugged and reliable.

BACKGROUND OF THE PRIOR ART

Support structures have heretofore been provided for permitting movement of an armrest between an operative arm support position and a retracted position. In many cases, the support structure has been such that the armrest projects and is in a position to be engaged even when it is in the retracted position, also providing a bad appearance from an esthetic standpoint. The support structures have also been such that it has not been possible to achieve the desired comfort for the user without increasing the width of the seating structure with which the support is associated.

SUMMARY OF THE INVENTION

This invention was evolved with the general object of overcoming the disadvantages of prior art constructions and of providing an armrest support structure in which an armrest is movable between an operative position providing maximum comfort for the user and an inoperative position in which it is unobtrusively stored.

Another object of the invention is to provide a retractible armrest support structure which is simple and inexpensive in construction and operation while being rugged and reliable.

In accordance with this invention, a back for a seating structure is formed with a recess along the portion of a corner formed by the front surface of the back and an adjoining side surface and connection means are provided between one end of an armrest and the back at the lower end of the recess to provide for swinging movement of the armrest between a generally upright storage position in the recess and a generally horizontal arm support position projecting forwardly from a lower end of the recess. The armrest is so formed as to fill the recess, having a pair of surfaces which respectively complete the front and side surfaces of the back and is thereby completely unobstructive in the storage position, as well as providing an attractive appearance from an esthetic standpoint. Preferably and in accordance with a specific feature, the side surface of the back and the corner recess are inclined inwardly and upwardly and the armrest is pivotal about an axis which is so oriented as to position the armrest in the inclined recess when in the storage position while at the same time, the armrest projects forwardly at substantially right angles to the front surface of the back when in the arm support position.

In accordance with very important features of the invention, the connection means are arranged for outward and inward sidewise movement of the end of the armrest for positioning the armrest inwardly when in the storage position and for positioning the armrest outwardly when in the arm support position. With the armrest being moved outwardly in the arm support position, the position of the arm of the user is moved outwardly and the space available for the body of the user is increased without however increasing the width of the back of the seating structure.

Another important specific feature is in the provision of actuating means for actuating the armrest outwardly in response to movement to the arm support position. Preferably, a pin projects from one of a pair of members which are interengaged for relative rotational and axial movement with means providing a generally cylindrical wall portion on the other of the members having an axially and angularly extending slot receiving the pin, the armrest being positively moved outwardly in response to pivotal movement thereof to the arm support position.

This invention contemplates other objects, features and advantages which will become more fully apparent from the following detailed description taken in conjunction with the accompanying drawings.

DESCRIPTION OF A PREFERRED EMBODIMENT

Figure 1:
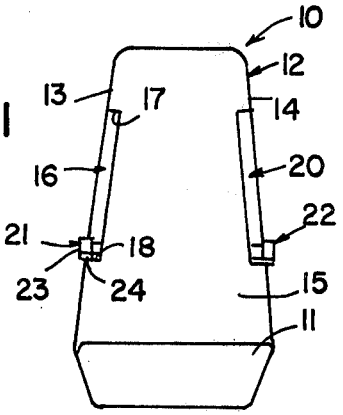
FIG. 1 is a front elevational view of a seating structure incorporating retractible armrest supports in accordance with the principles of the invention.
Figure 2:
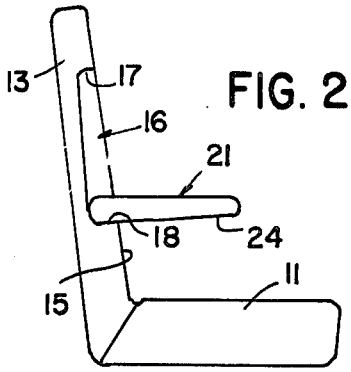
FIG. 2 is a side elevational view of the seating structure of FIG. 1.

Reference numeral 10 generally designates a seat incorporating an armrest support in accordance with the principles of this invention, the illustrated seat 10 being a "bucket" type seat suitable for use in vehicles, it being understood that the principles of the invention can be applied to other types of seating structures.

The illustrated seat 10 includes a seat 11 and a back 12, the back 12 having opposite side surfaces 13 and 14 and a front surface 15.

The side surface 13 and the front surface 15 adjoin in a corner in which a recess 16 is formed, the recess 16 having an upper end 17 spaced below the upper end of the back 12 and having a lower end 18 spaced above the seat 11. A similar recess 20 is formed on the other side of the back, along a portion of the corner formed by the adjoining portions of the side surface 14 and front surface 15.

A pair of armrests 21 and 22 are provided with connection means connecting end portions thereof to the back 12 for swinging movement of the armrests 21 and 22 between generally horizontal arm support positions projecting forwardly from lower ends of the recesses 16 and 20, as illustrated, and generally upright storage positions in which the armrests 21 and 22 are disposed in the recesses 16 and 20. The armrests 21 and 22 are so formed as to just fill the recesses 16 and 20 and to provide a smooth appearance. Thus surfaces 23 and 24 of the armrest 21 which are respectively outer and lower side surfaces in the illustrated arm support position form smooth continuations of the side and front surfaces 13 and 15 of the back 12 when the armrest 21 is disposed in the storage position in the recess 16.

Figure 3:
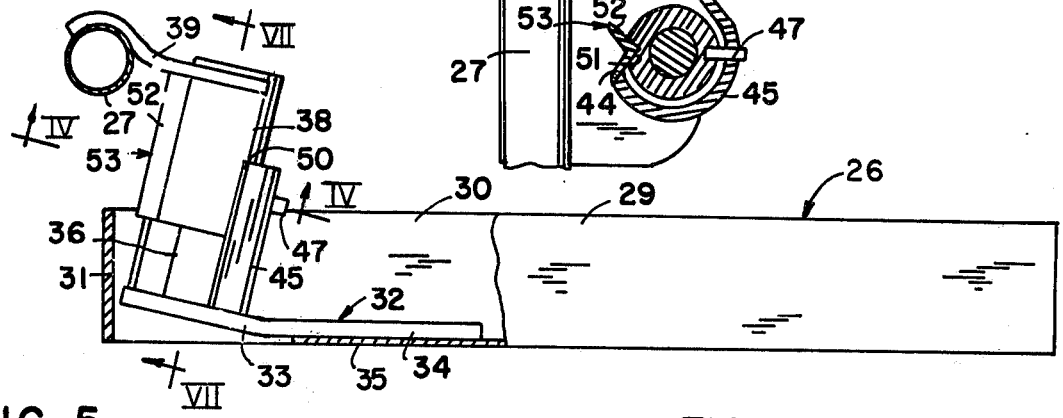
FIG. 3 is a top plan view of connection means and internal structure of an armrest and a back used in one of the armrests supports of FIGS. 1 and 2.

FIG. 3 is a top plan view of support structure for the armrest 21 which includes a frame structure 26 on which suitable padding and upholstering material may be disposed to form the armrest 21, the frame structure 26 being supported from the generally upright tubular member 27 which is disposed within the back 12 and which is part of a frame structure on which suitable padding and upholstering material is disposed to form the back 12.

The frame structure 26 for the armrest 21 includes parallel walls 29 and 30 joined by semi-cylindrical wall portion 31, the walls 29 and 30 being upper and lower walls in the arm support position as illustrated in FIG. 3. A plate 32 is secured between the walls 29 and 30 and has an end portion 33 the peripheral edge of which is disclosed against the internal surface of the end wall portion 31, being preferably welded thereto. Another portion 34 of the plate 32 is secured between the walls 29 and 30 and against a side wall portion 35 also secured between the walls 29 and 30.

Figure 7:
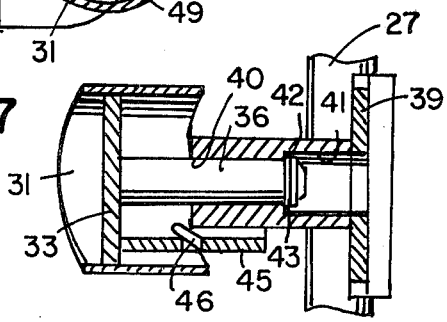
FIG. 7 is a sectional view taken substantially along line VII—VII of FIG. 3.

A post 36 is welded or otherwise secured at one end to the plate 33 and extends within a sleeve 38 having an end welded or otherwise secured to a plate 39 which is welded or otherwise secured to the upright frame member 27 of the back 12. Sleeve 38 has a cylindrical inner surface portion 40 which forms a bearing surface for the post 36, for both relative rotational and relative axial movements, and also has a larger diameter internal cylindrical surface 41 with a shoulder 42 between surfaces 40 and 41 being engagable by a split ring 43 secured in a recess near the free end of the post 36, as shown in FIG. 7. Accordingly, the frame structure 26 for the armrest 21 is supported for both relative rotational and relative axial movement with respect to the frame member 27 of the back 12, outward axial movement being limited by engagement of split ring 43 with shoulder 42 and inward axial movement being limited by engagement of the plate portion 33 with the end of the sleeve 38.

Figure 4:
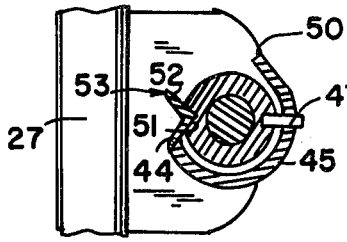
FIG. 4 is a sectional view taken substantially on line IV—IV of FIG. 3.
Figure 5:
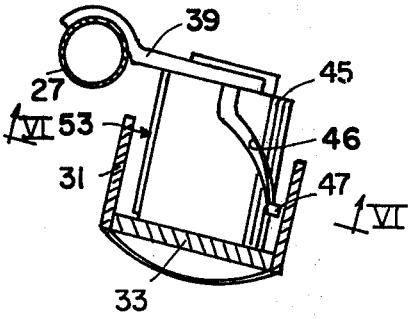
FIG. 5 is a view of a portion of the structure shown in FIG. 3 but with the parts corresponding to a storage position of an armrest rather than an arm support position as shown in FIG. 3.
Figure 6:
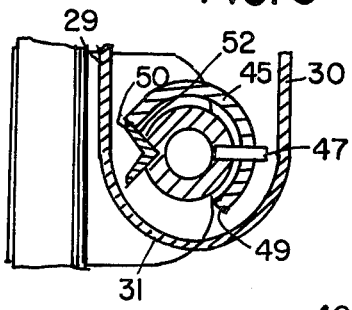
FIG. 6 is a sectional view taken substantially along line VI—VI of FIG. 5.

A generally semi-cylindrical member 45 is secured to the portion 33 of plate 32 in generally concentric relation to the axis of the post 36 and on the outside of the sleeve 38. The member 45 has a slot 46 therein which extends both angularly and axially and which receives a pin 47 projecting radially from the sleeve 38. The slot 46 is so formed that when the armrest 21 is moved from the storage position in recess 16 to the illustrated arm support position, the end of the armrest 21 is cammed outwardly to the position as illustrated in FIGS. 3, 4 and 7. When the armrest 21 is swung in the opposite direction to be disposed in the recess 16, the end of the armrest 21 is moved inwardly through the coaction of pin 47 with the slot 46 and the structural parts are in the positions as illustrated in FIGS. 5 and 6. Rotational movements of the armrest 21 are limited by engagement of ends 49 and 50 of the member 45 with surfaces 51 and 52 of a member 53 which is secured to the sleeve 38 and the support plate 39.

The outward displacement of the armrest 21 when it is moved to the arm support position is very important in increasing the space available for the body of the person sitting in the seat 10 and in moving the position of the support of his arm outwardly, but without increasing the width of the seat structure.

It is noted that as shown in FIGS. 3 and 7, the axis of the sleeve 38 is in a generally horizontal plane but is at an angle to the front surface of the back 12. The axis of the post 36 is similarly of an angle which is less than a right angle with respect to the main portion of the armrest frame structure 26, the portion 33 from which the post 36 is supported being at an angle to the portion 34. As an overall result, the armrest 21 projects straightforwardly when in the arm support position and, when swung upwardly to the storage position is disposed in the recess 16 which, as shown, is inclined upwardly and inwardly, as well as rearwardly. Accordingly, the required width is reduced at the operating level of the armrest and, in addition, the opposite sides of the back may be sloped inwardly and upwardly as shown.

It will be understood that modifications and variations may be effected without departing from the spirit and scope of the novel concepts of this invention.

I claim as my invention:

1. In a seating structure, an upstanding back having a front surface, at least one side surface adjoining said front surface to form a corner and a recess along a portion of the said corner so formed, an arm rest, and connection means connecting one end of said arm rest to said back adjacent the lower end of said recess for swinging movement of said arm rest between a generally upright storage position in said recess and a generally horizontal arm support position projecting forwardly from a lower end of said recess, said connection means comprising a pair of members interengaged for relative rotational movement about a predetermined axis and for relative axial movement along said axis, means securing one of said members to said back, means securing the other of said members to said one end of said arm rest, and actuating means for effecting relative axial movement of said members in response to rotation thereof to move said one end of said arm rest a substantial distance transversely outwardly from an inward position when in said storage position to an outward position when in said arm support position to substantially increase the width of the space available for the body of the user.

2. In a seating structure as defined in claim 1, said side surface of said back and said corner recess being inclined inwardly and upwardly, and said axis being so oriented as to position said arm rest in said recess when in said storage position and to cause said arm rest to extend forwardly at substantially right angles to said front surface of said back when in said arm support position.

3. In a seating structure as defined in claim 1, said actuating means comprising a pin projecting from one of said members radially outwardly away from said axis, and means providing a generally cylindrical wall portion on the other of said members having an axially and angularly extending slot receiving said pin.

* * * * *